US005516280A

United States Patent [19]

Kostiuk et al.

[11] Patent Number: 5,516,280

[45] Date of Patent: May 14, 1996

[54] APPARATUS AND METHOD FOR BURNING A LEAN, PREMIXED FUEL/AIR MIXTURE WITH LOW NOX EMISSION

[75] Inventors: Larry W. Kostiuk, Edmonton, Canada; Robert K. Cheng, Kensington, Calif.

[73] Assignee: The Regents, University of California, Berkeley, Calif.

[21] Appl. No.: 147,380

[22] Filed: Nov. 3, 1993

[51] Int. Cl.[6] ..... F23D 14/46

[52] U.S. Cl. ..... 431/350; 431/354; 239/552

[58] Field of Search ..... 431/350, 347, 431/355, 349, 354; 60/749; 239/552

[56] References Cited

U.S. PATENT DOCUMENTS

| | | | |
|---|---|---|---|
| 1,941,755 | 1/1934 | Potter | 431/349 |
| 1,978,477 | 10/1934 | Robertson | 431/349 |
| 2,006,804 | 7/1935 | Gwathmey | 431/350 |
| 2,237,889 | 4/1941 | Rickert | 431/349 |
| 2,537,542 | 1/1951 | Norman | 431/349 |
| 2,610,675 | 9/1952 | Downe | 239/552 |
| 2,839,131 | 6/1958 | Pattinson | 431/349 |
| 5,325,660 | 7/1994 | Taniguchi et al. | 60/737 |

FOREIGN PATENT DOCUMENTS

| | | | |
|---|---|---|---|
| 1528806 | 5/1968 | France | 431/349 |

OTHER PUBLICATIONS

B. Bedat, L. W. Kostiuk, R. K. Cheng, "Characterization of Acoustic Effects on Flame Structures by Beam Deflection Technique", Oct. 1993/Lawrence Berkeley Laboratory University of California–Energy & Environment Division. 15 pages.

L. W. Kostiuk, L. Zhou, R. K. Chang, "The Effects of Gravity on Wrinkled Laminar Flames", Sep. 1992/Lawrence Berkeley Laboratory/University of California–Energy & Environment Division. 17 pages.

*Primary Examiner*—Carroll B. Dority
*Attorney, Agent, or Firm*—Paul R. Martin

[57] ABSTRACT

An apparatus for enabling a burner to stably burn a lean fuel/air mixture. The burner directs the lean fuel/air mixture in a stream. The apparatus comprises an annular flame stabilizer; and a device for mounting the flame stabilizer in the fuel/air mixture stream. The burner may include a body having an internal bore, in which case, the annular flame stabilizer is shaped to conform to the cross-sectional shape of the bore, is spaced from the bore by a distance greater than about 0.5 mm, and the mounting device mounts the flame stabilizer in the bore. An apparatus for burning a gaseous fuel with low NOx emissions comprises a device for premixing air with the fuel to provide a lean fuel/air mixture; a nozzle having an internal bore through which the lean fuel/air mixture passes in a stream; and a flame stabilizer mounted in the stream of the lean fuel/air mixture. The flame stabilizer may be mounted in the internal bore, in which case, it is shaped and is spaced from the bore as just described. In a method of burning a lean fuel/air mixture, a lean fuel/air mixture is provided, and is directed in a stream; an annular eddy is created in the stream of the lean fuel/air mixture; and the lean fuel/air mixture is ignited at the eddy.

23 Claims, 6 Drawing Sheets

APPARATUS AND METHOD FOR BURNING A LEAN, PREMIXED FUEL/AIR MIXTURE WITH LOW NOX EMISSION

FIELD OF THE INVENTION

The invention relates to an apparatus and method for stably burning lean, premixed fuel/air mixtures with high efficiency and low emissions of oxides of nitrogen.

BACKGROUND OF THE INVENTION

A significant portion of the emissions of oxides of nitrogen in the United States is accounted for by emissions from various gas-fired furnaces used in industrial and domestic heating, and in other industrial processes. Such furnaces mix relatively little air with a gaseous fuel (a gas or a vaporized liquid), most commonly natural gas, upstream of the flame. Most of the mixing of the air required for combustion with the fuel takes place at the flame. The resulting flame has an intense blue conical zone surrounded by a larger, violet zone. Initial burning of the part of the fuel with the air mixed with the fuel occurs in the conical zone. The rest of the fuel is burned in the surrounding violet zone with air that enters the flame from outside.

The main mechanism for producing oxides of nitrogen (NOx) in rich flames is the thermal combination of atmospheric oxygen and nitrogen, a process that has a rate that varies exponentially with temperature. High temperatures are reached in a rich or near-stoichiometric flame, with the result that considerable quantities of NOx are produced.

The Clean Air Act Amendments of 1990 has empowered local areas to impose regulations setting limits on the NOx emissions from domestic and industrial gas furnaces. The United States Environmental Protection Agency is likely to require existing major industrial furnaces in so-called ozone nonattainment areas, such as Southern California and New England, to retrofit equipment to reduce emissions by the middle of 1995. New equipment will have to meet more stringent requirements.

A report issued in July 1993 by the Gas Research Institute (GRI) entitled Low NOx BURNERS FOR INDUSTRIAL APPLICATIONS describes several approaches to reducing NOx emissions developed by the GRI in cooperation with burner manufacturers and the gas industry. The approaches described include:

Low Excess Air, in which the amount of combustion air provided to the flame is reduced to reduce temperatures inside the flame.

Staged Combustion, in which fuel and air are added to the flame in stages to reduce peak flame temperatures. This process also creates fuel rich zones that lower NOx by so-called "reburning."

Flue-gas recirculation, in which exhaust gas, which has had its oxygen depleted, is re-mixed with the combustion air to reduce the flame temperature.

Oxygen/fuel combustion, in which NOx is substantially reduced by burning the fuel with pure oxygen, thus eliminating the nitrogen component of NOx. The temperature of the exhaust gas is reduced to one below that at which significant NOx levels are produced before the exhaust gas comes into contact with air.

Gas Reburning, in which additional fuel is injected into the exhaust stream, or staged combustion is used, to reduce the NOx back to nitrogen.

Surface Stabilized Combustion, in which gas is burned in or near a porous ceramic or metallic surface. The surface absorbs heat from the flame to lower the flame temperature.

The above approaches, although providing the possibility of reduced NOx emissions are relatively complex, and would be difficult to retrofit to existing burners.

Many of the above approaches involve reducing the flame temperature to reduce NOx emissions. It is also known, for example, in reducing NOx emissions from automobile engines, that adding excess air to the fuel reduces peak combustion temperatures, and significantly reduces NOx emissions. However, to bum such mixtures successfully, automotive engines employ stratified mixtures, or large amounts of swirl in the combustion chamber. If the amount of air premixed with the fuel is increased in a conventional gas burner, the flame becomes unstable. When the flame becomes unstable, it will detach from the burner, and combustion will stop. This is highly undesirable.

OBJECTS AND SUMMARY OF THE INVENTION

It is an object of the invention to provide a burner capable of burning a lean, premixed fuel/air mixture with high efficiency, and low emission of NOx and unburned hydrocarbons (HC).

It is an object of the invention to provide a means for retrofitting existing burners to bum a lean, premixed fuel/air mixture with high efficiency, and low emissions of NOx and unburned hydrocarbons.

Accordingly, the invention provides an apparatus for enabling a burner to stably bum a lean fuel/air mixture. The burner directs the lean fuel/air mixture in a stream. The apparatus comprises an annular flame stabilizer and a device for mounting the flame stabilizer in the fuel/air mixture stream.

The burner may include a body having an internal bore. The annular flame stabilizer may be shaped to conform to the cross-sectional shape of the bore and may be spaced from the bore by a distance greater than about 0.5 mm. The mounting device may mount the flame stabilizer in the bore.

The invention also provides an apparatus for burning a gaseous fuel with low NOx and low HC emission. The apparatus comprises a device for premixing air with the fuel to provide a lean fuel/air mixture. The apparatus also includes a nozzle having an internal bore through which the lean fuel/air mixture passes in a stream. Finally, the apparatus includes a flame stabilizer mounted in the stream of the lean fuel/air mixture.

The flame stabilizer may be mounted in the internal bore, in which case, it may be shaped to conform to the cross sectional shape of the internal bore and be spaced from the internal bore by a distance greater than about 0.5 mm.

Finally, the invention provides a method of burning a lean fuel/air mixture with low NOx and low HC emission. In the method, a lean fuel/air mixture is provided, and is directed in a stream. An annular eddy is created in the stream of the lean fuel/air mixture, and the lean fuel/air mixture is ignited at the eddy.

DETAILED DESCRIPTION OF THE INVENTION

Figure 1:
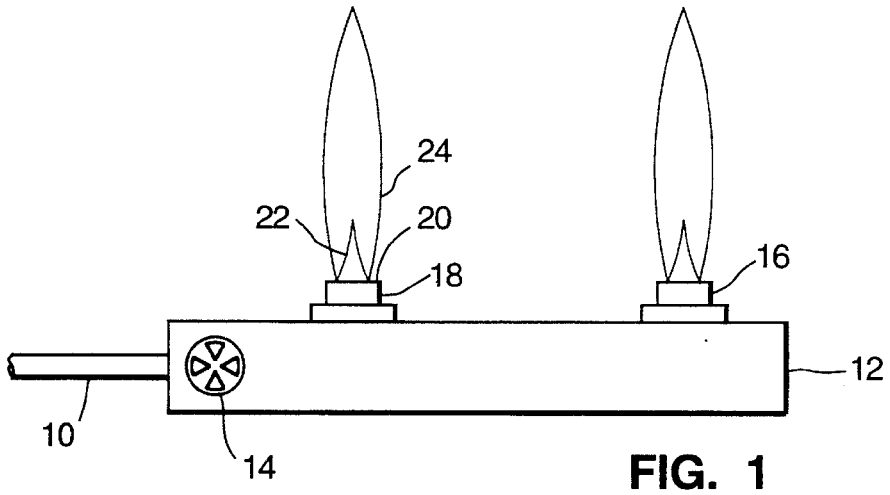
FIG. 1 shows a natural gas burner of the type found in modern domestic heating furnaces as an illustration of a typical known burner.

FIG. 1 shows a natural gas burner of the type found in modern domestic heating furnaces as an illustration of a typical known burner. Natural gas from the gas pipe 10 enters the plenum 12 via a jet (not shown). The gas emitted from the jet draws air into the plenum through the butterfly valve 14. The relatively small amount of air drawn through the butterfly valve in the plenum 12 is premixed with the gas, and the resulting fuel-rich gas/air mixture, with a fuel/air equivalence ratio of 1.3 or more leaves the plenum through the nozzles 16 and 18. The fuel/air mixture burns at the exit, such as the exit 20, of each nozzle with the typical fuel-rich flame, consisting of the intense blue conical zone 22 surrounded by the larger, violet zone 24.

Figure 2:
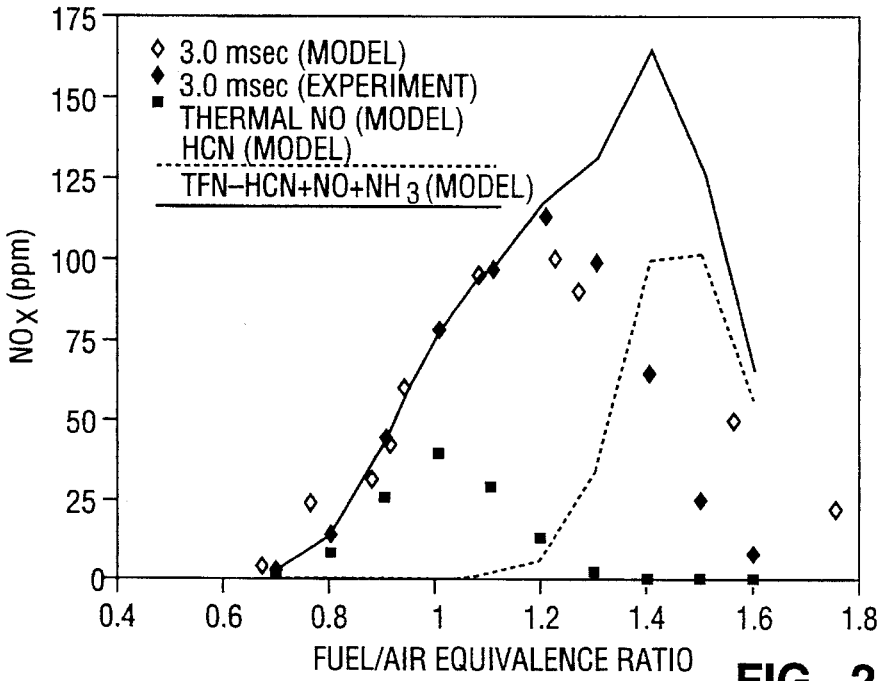
FIG. 2 is a plot of NOx emissions in parts per million (ppm) against the fuel/air equivalence ratio of the fuel/air mixture.

FIG. 2 illustrates both the problem of NOx emissions generated by conventional gas-fuelled burners, and the mechanism by which NOx emissions are reduced in the burner according to the invention. FIG. 2 is a plot of NOx emissions in parts per million (ppm) against the fuel/air equivalence ratio of the fuel/air mixture. The fuel/air mixture burned in the conventional gas burner shown in FIG. 1 is fuel-rich, with a fuel/air equivalence ratio of about 1.3 or more. FIG. 2 shows that, with this equivalence ratio, the NOx level produced by the conventional burner shown in FIG. 1 is greater than about 150 ppm.

FIG. 2 also shows that the level of NOx emissions can be reduced to below 10 ppm by increasing the amount of air premixed with the fuel so that the fuel/air equivalence is reduced below about 0.8. However, as described above, such lean fuel/air mixtures will not burn reliably in a conventional burner. Moreover, since such lean fuel/air mixtures are difficult to burn, dilution of the fuel/air mixture by ambient air will convert parts of the lean fuel/air mixture into a mixture that will not burn at all. This reduces the efficiency of the burner, and increases the emission of unburned hydrocarbons, both of which are undesirable.

Figure 3:
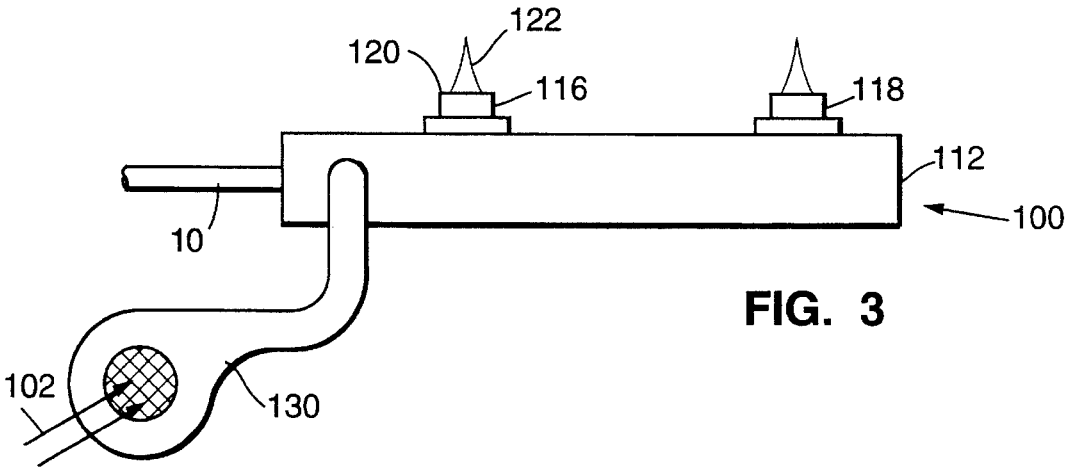
FIG. 3 shows a first embodiment of the burner according to the invention.

FIG. 3 shows the natural gas burner 100 according to the invention. Parts corresponding to those of the conventional burner shown in FIG. 1 are labelled with the same reference numeral with 100 added. Natural gas from the gas pipe 110 enters the plenum 112. Air for combustion, indicated by the arrows 102, is forced into the plenum 112 under a small positive pressure by the blower 130. The pressures of the air and the fuel are controlled to achieve the desired fuel/air equivalence ratio. The resulting lean gas/air mixture leaves the plenum through the nozzles 116 and 118 according to the invention. Two nozzles are shown. The apparatus may alternatively have only one nozzle, or more than two nozzles.

The fuel/air mixture burns at the exit, such as the exit 120, of each nozzle in a short blue conical combustion zone 122. Since all the fuel is burned in the conical zone 122, the flame lacks the surrounding violet zone of the conventional burner. The excess air in the combustion zone reduces the peak temperature in the combustion zone, and hence the production of NOx.

Figure 4A:
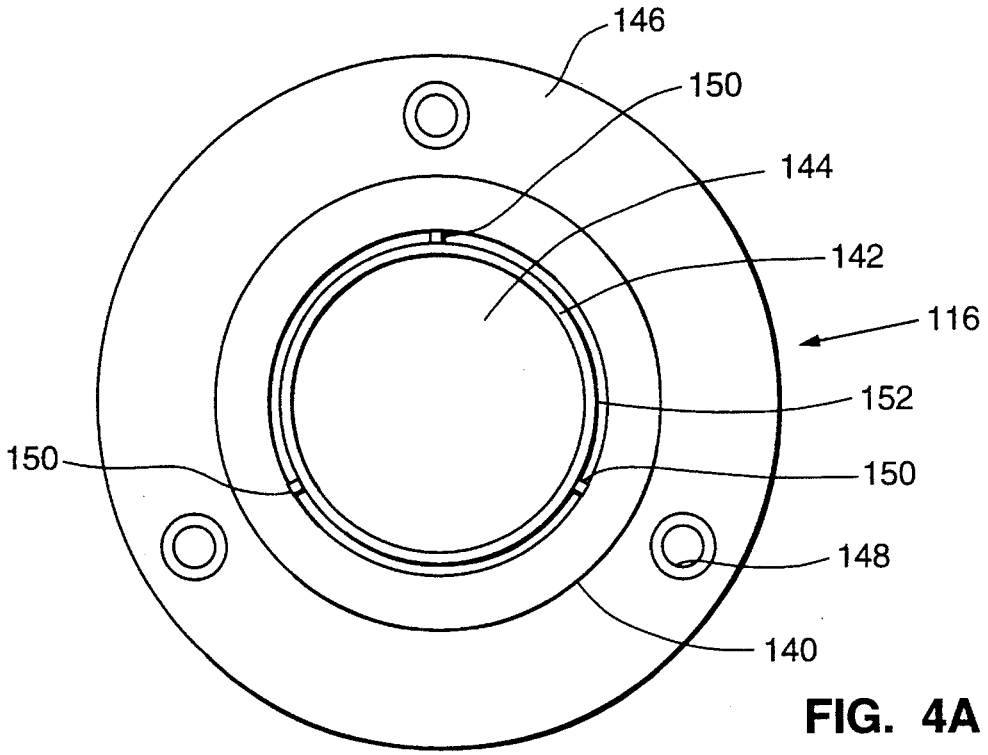
FIGS. 4A and 4B show a plan view and a cross sectional elevational view, respectively, of the nozzle of the burner in the first embodiment of the invention.
Figure 4B:
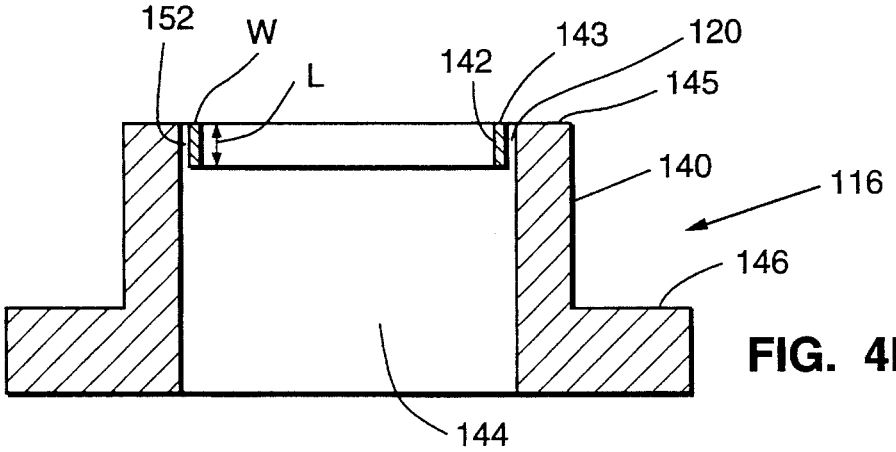

In the burner according to the invention shown in FIG. 3, the flame resulting from the combustion of a lean fuel/air mixture is stabilized by the nozzles 116 and 118 according to the invention, which are shown in detail in FIGS. 4A and 4B. FIGS. 4A and 4B show a plan view and a cross sectional elevational view of the nozzle 116 according to the invention. The nozzle 116 will reliably bum a lean premixed fuel/air mixture with high efficiency.

The nozzle 116 consists of the body portion 140 and the flame stabilizer 142. The body portion 140 is similar to the body portion of the conventional nozzle 16 (FIG. 1 ). The body portion includes the bore 144, which is preferably cylindrical, terminating at the exit 120. The body portion 140 is adapted for attachment to the plenum 112. The flange 146 with the screw holes 148 is shown as a typical provision for attaching the body portion to the plenum: The body portion could be attached to the plenum in other ways (not shown), or could be formed as an integral part of the plenum.

In the embodiment shown, which is intended for use in domestic furnaces, the bore 144 of the body portion 140 has a diameter of about 25 mm(1"). The embodiment shown can readily be scaled for a body portions with a bore up to about 100 mm. The inventors believe that the embodiment shown may also be scalable to the bore diameters used in heavy industrial applications, i.e., up to a bore diameter of 1 meter (39") or larger.

The flame stabilizer 142 is narrow annulus of metal or ceramic disposed within the bore 144 of the body portion 140. In the preferred embodiment, the flame stabilizer was made of stainless steel. Mild steel, cast iron, aluminum, copper, brass, a suitable ceramic material, or other suitable materials could be used. Although the downstream edge of the flame stabilizer is subject to combustion products having a temperature of about 2,000 degrees Celsius, most of the flame stabilizer 142 is cooled by the incoming fuel-air mixture, so a material that will withstand temperatures of about 1,000 degrees Celsius can be used.

In the preferred embodiment, the flame stabilizer is made of a 1 mm thick strip of stainless steel, about 2 mm wide, and is shaped to conform to the cross-sectional shape of the bore 144 of the body portion 140, spaced from the bore by a distance of greater than about 0.5 mm. Since, in the preferred embodiment, the bore 144 has a circular cross section, the flame stabilizer is shaped to have a circular shape. If the cross-sectional shape of the bore 144 is other than circular, the flame stabilizer would be shaped to have the same shape as the cross-sectional shape of the bore. The spacing between the bore 144 and the flame stabilizer 142 should preferably remain substantially constant throughout and should remain greater than about 0.5 mm.

The flame stabilizer: 142 is shown in FIGS. 4A and 4B with rectangular cross section, which is the preferred cross sectional shape. Other relatively blunt cross sectional shapes, such as square, circular, oval, etc. also work. A blunt shape is required so that the flame stabilizer will cause a downstream eddy in the fuel/air mixture, as will be described below. Hence, the flame stabilizer should not be given an aerofoil cross-sectional shape. The width W of the flame stabilizer depends on the velocity of the fuel/air mixture in the bore 144. In the 25 mm nozzle described above, a 1 mm wide flame stabilizer spaced 1 mm from the bore 144 provides an acceptably stable flame with mixture velocities between 0.5 and 6 meters/sec. The width W of the flame stabilizer should be increased for mixture velocities towards the upper end of this range, and beyond.

The height h of the flame stabilizer 142 can be between about 0.3 mm and about 10 mm.

The flame stabilizer 142 is preferably mounted in the bore 144 of the body portion 140, spaced from the bore 144 by a distance just greater than about 0.5 mm. The efficiency of the combustion process is maximized by making as much of the fuel/air mixture pass through the flame stabilizer as possible. This requires that the flame stabilizer fit in the bore as closely as possible. However, if the flame stabilizer fits in the bore so closely that the spacing between the flame stabilizer and the bore is less than about 0.5 mm, the proximity of the surfaces of the bore and the flame stabilizer quenches the secondary flame between the flame stabilizer and the bore. This secondary flame is indicated by 178 in FIG. 6. Without the secondary flame, the ability of the flame stabilizer to stabilize the flame is significantly reduced. On the other hand, a significant reduction in efficiency and a significant increase in HC emission will occur if the spacing between the flame stabilizer and the bore exceeds about 15% of the bore diameter, i.e., about 4 mm in the 25 mm nozzle. The preferred spacing of about 1 mm lies comfortably between these limits, and provides reliable stabilization with a negligible reduction in efficiency.

The flame stabilizer 142 is preferably mounted in the bore 144 of the body portion 140 such that the downstream face 143 of the flame stabilizer is level with the top face 145 of the body portion. The downstream face of the flame stabilizer may project from the top face 145 slightly, but having the downstream face of the flame stabilizer below the level of the top face should be avoided to prevent the flame anchored to the flame stabilizer from heating the body portion.

Figure 4C:
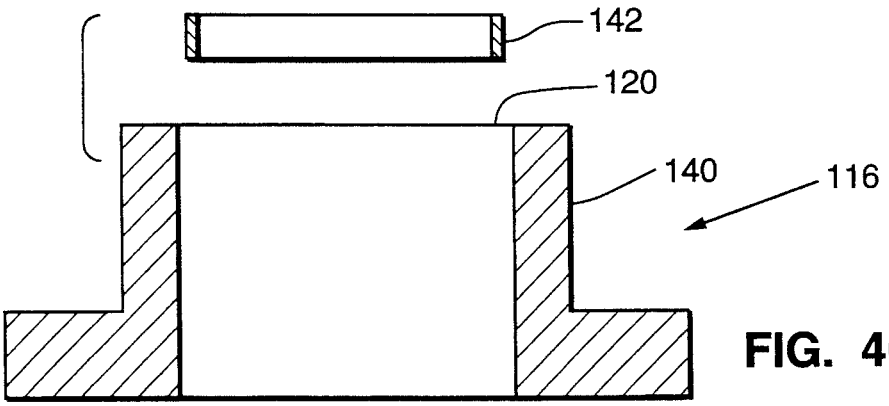
FIG. 4C is a cross sectional elevational view of the nozzle of the burner of the first embodiment of the invention with the flame stabilizer in an alternative location.

The flame stabilizer 142 may be mounted outside the bore, axially spaced from the exit 120, as shown in FIG. 4C. This arrangement will stabilize the flame at the flame stabilizer, but is less efficient, and produces a greater output of unburned hydrocarbons, than mounting the flame stabilizer in the bore. This is because fuel can leak laterally from the stream of the fuel/air mixture, and miss the flame; and also because ambient air can weaken parts of the fuel/air mixture to the point at which they will no longer burn.

Figure 5A:
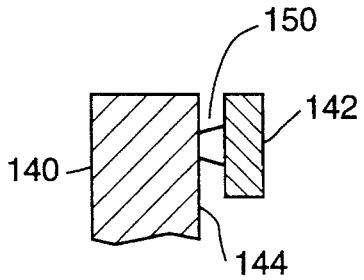
FIG. 5A is a cross sectional view of part of the body portion of the nozzle and part of the flame stabilizer showing a first way of mounting the flame stabilizer in the bore of the body portion.

In FIGS. 4A and 4B, the flame stabilizer 142 is shown mounted in the bore 144 of the body portion 140 by the lugs 150. The flame stabilizer 142 is formed with the lugs projecting its outer surface 152, as shown in FIGS. 4A and 5A. In the embodiment shown in FIG. 5A, the lugs project into the bore 144 of the body portion 140, making the flame stabilizer 142 a press fit into the bore 144.

Figure 5B:
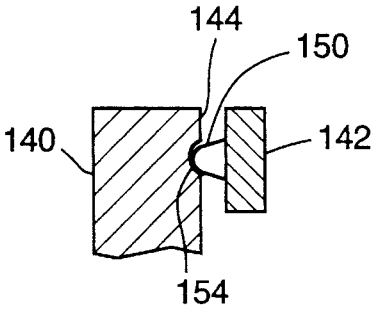
FIG. 5B is a cross sectional view of part of the body portion of the nozzle and part of the flame stabilizer showing a second way of mounting the flame stabilizer in the bore of the body portion.

In the embodiment shown in FIG. 5B, indentations or a groove 154 are formed in the bore 144 of the body portion 140. The lugs 150 engage in the indentations or groove 154 to provide a more positive location of the flame stabilizer in the bore.

Figure 5C:
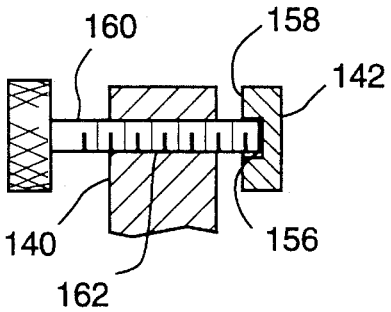
FIGS. 5C and 5D are respectively a cross sectional view of part of the body portion of the nozzle and part of the flame stabilizer and a plan view of the body portion and the flame stabilizer showing a third way of mounting the flame stabilizer in the bore of the body portion.
Figure 5E:
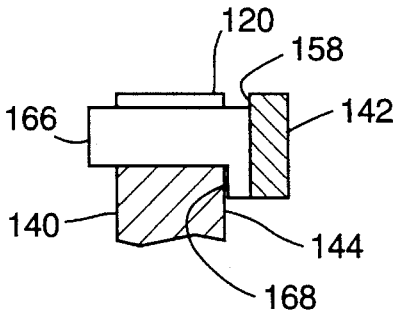
FIGS. 5E and 5F are respectively a cross-sectional view of part of the body portion of the nozzle and part of the flame stabilizer and a plan view of the body portion and the flame stabilizer showing a fourth way of mounting the flame stabilizer in the bore of the body portion.
Figure 5D:
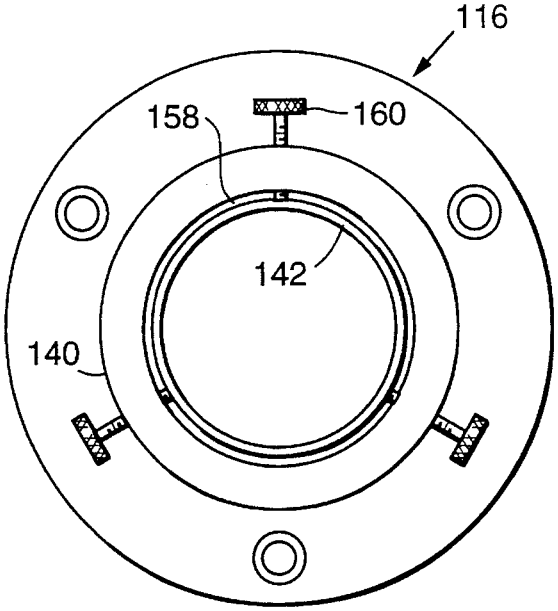

In the embodiment shown in FIGS. 5C and 5D, indentations or a groove 156 are formed in the outer curved surface 158 of the flame stabilizer 142. Plural set screws, such as the set screw 160, engage in corresponding threaded bores, such as the threaded bore 162, in the body portion 140, and project into the bore 144, where they engage in the indentations or the groove 156 in the flame stabilizer. Alternatively, the indentations or groove 156 may be press fit onto plural lugs (not shown) projecting inwards from the body portion 140 into the bore 144.

Figure 5F:
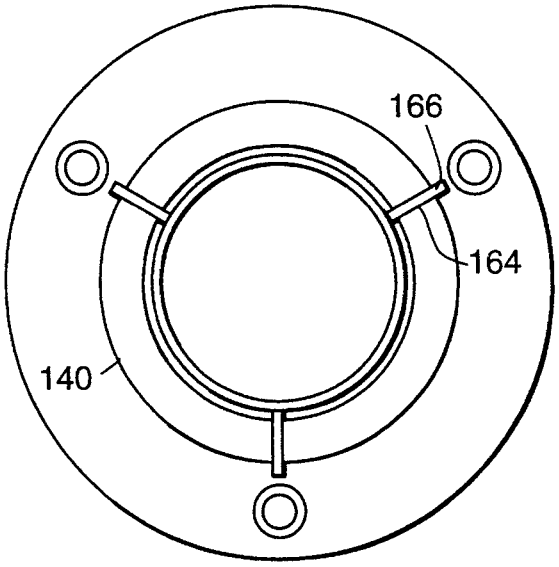

In the embodiment shown in FIGS. 5E and 5F, plural radial slots, such as the slot 164, are provided in the body portion 140, adjacent the exit 120. The flame stabilizer 142 is formed with plural ears, such as the ear 166, which engage in corresponding ones of the slots in the body portion. Each of the ears is formed with the step 168, which positively defines the spacing between the bore 144 and the outer surface 158 of the flame stabilizer.

Figure 5G:
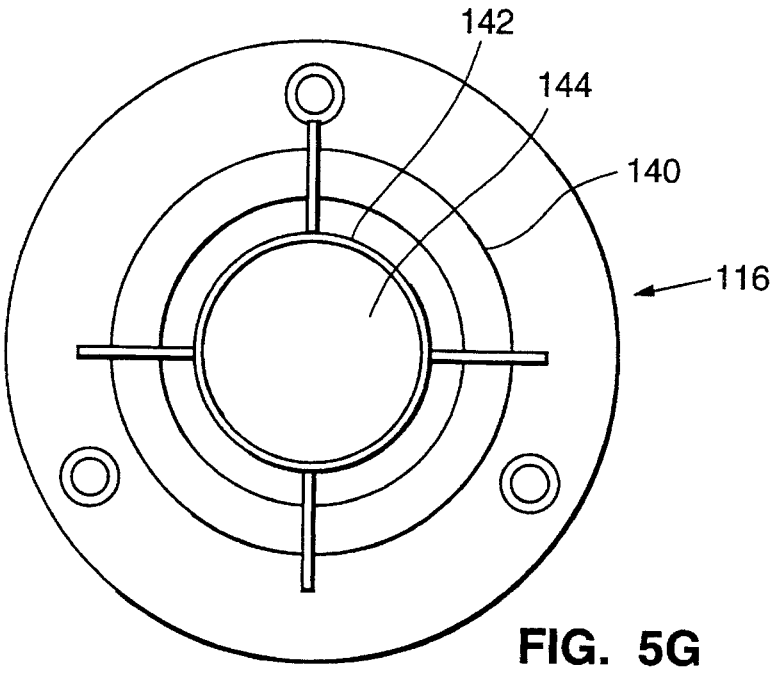
FIGS. 5G and 5H are respectively a cross-sectional view of part of the body portion of the nozzle and part of the flame stabilizer and a plan view of the body portion and the flame stabilizer showing a "universal" retrofit flame stabilizer designed for mounting on nozzles of different diameters.
Figure 5H:
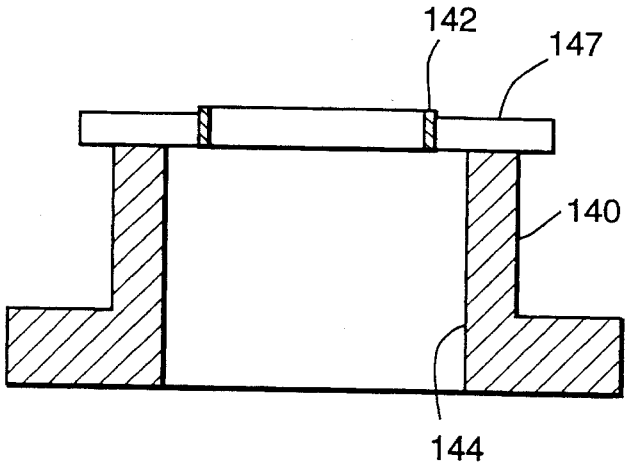

FIGS. 5G and 5H show a "universal" retrofit flame stabilizer designed for mounting on nozzles of different diameters, such as the nozzle 116. To fit on nozzles of different diameters, the radial supports 147 rest on the body portion 140 to mount the flame stabilizer 142 outside the bore 144 of the body portion 140. The flame stabilizer 142 has a diameter somewhat smaller than the bore. The flame stabilizer mounted as shown provides a stable flame with a lean fuel/air mixture, but the burner efficiency is lower than an arrangement in which the flame stabilizer is mounted inside the bore, and is spaced from the bore by a distance slightly greater than about 0.5 mm.

The above ways of mounting the flame stabilizer 142 in the 144 are intended to be illustrative. The flame stabilizer can be mounted in the bore in many other ways.

The flame stabilizer 142 enables a conventional burner, such as that shown in FIG. 1, to be converted, or a new burner, to reliably burn lean fuel/air mixtures, with high efficiency, and to produce NOx levels below 10 pans per million. Measurements taken using the 25 mm nozzle with the preferred embodiment of the flame stabilizer described above show NOx levels of 6.5 parts per million with a fuel/air equivalence of 0.65. The flame stabilizer overcomes the inability of conventional burners to burn lean fuel/air mixtures by providing an anchor point and re-ignition point for the flame, thereby preventing the flame from detaching from the nozzle, as in conventional burners. The flame stabilizer enables the burner to burn the lean mixture with high efficiency by directing the fuel/air mixture to the flame, and by preventing dilution of the mixture.

Figure 6:
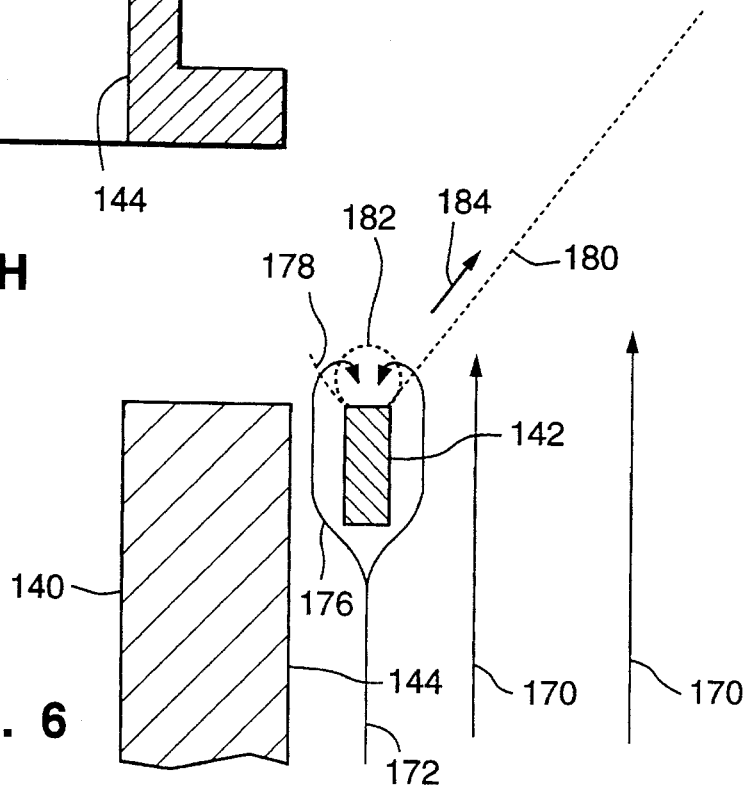
FIG. 6 is a cross-sectional view of part of the body portion of the nozzle and part of the flame stabilizer for illustrating the operation of the flame stabilizer according to the invention.

The inventors believe that the flame stabilizer operates as shown in FIG. 6. The premixed fuel/air mixture flows up the bore 144, as shown by the arrows 170. The flow may be laminar or turbulent. Part of the flow of the fuel/air mixture, such as that indicated by the arrow 172 is interrupted by the stabilizing ring 142. The flame stabilizer causes eddies in the mixture flow, as indicated by the arrows 174 and 176. The eddies in the mixture intercept the flame boundaries 178 and 180, where the mixture burns. As a result, hot combustion gases flow into the region 182 at the downstream side of the flame stabilizer 142. The hot combustion gases serve as a constantly-renewed, and stably located ignition source for the incoming mixture. The ignition source provided by the eddy downstream of the flame stabilizer overcomes any tendency of the flame to detach from the exit 120 of the nozzle.

Figure 7A:
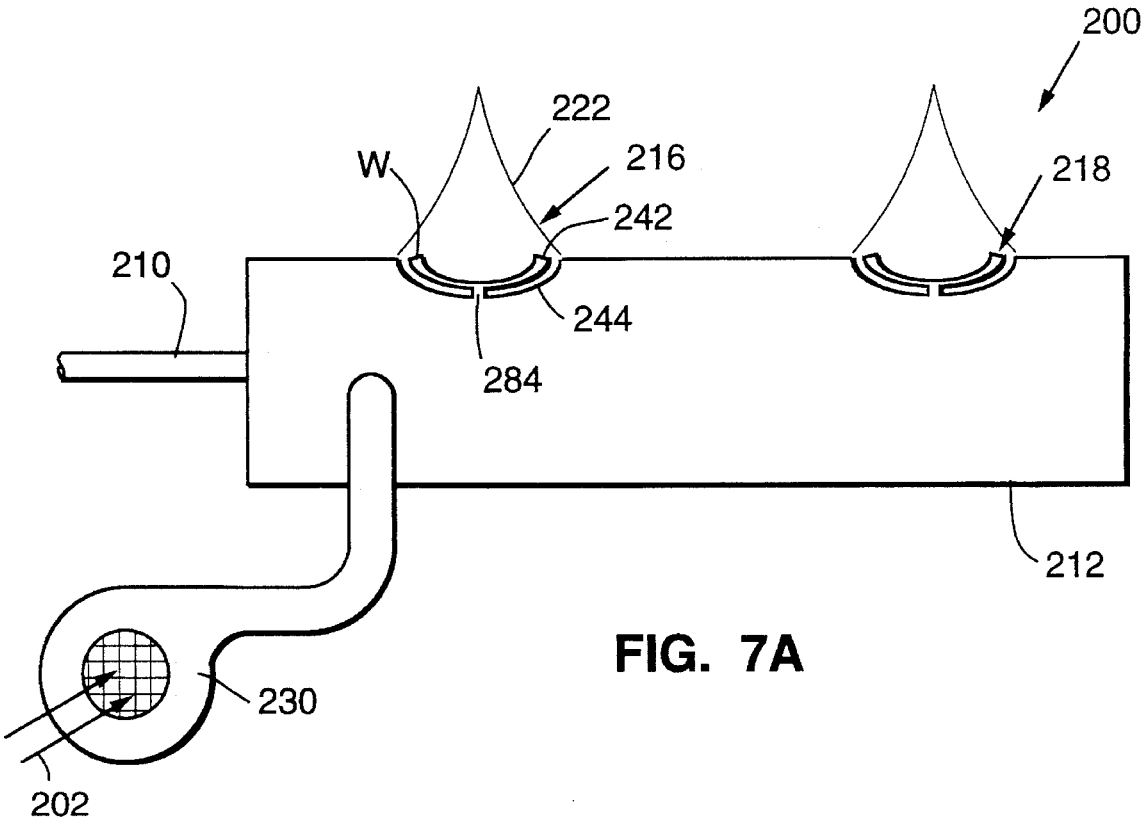
FIGS. 7A and 7B are side elevation and a plan view, respectively, of a second embodiment of a burner according to the invention.
Figure 7B:
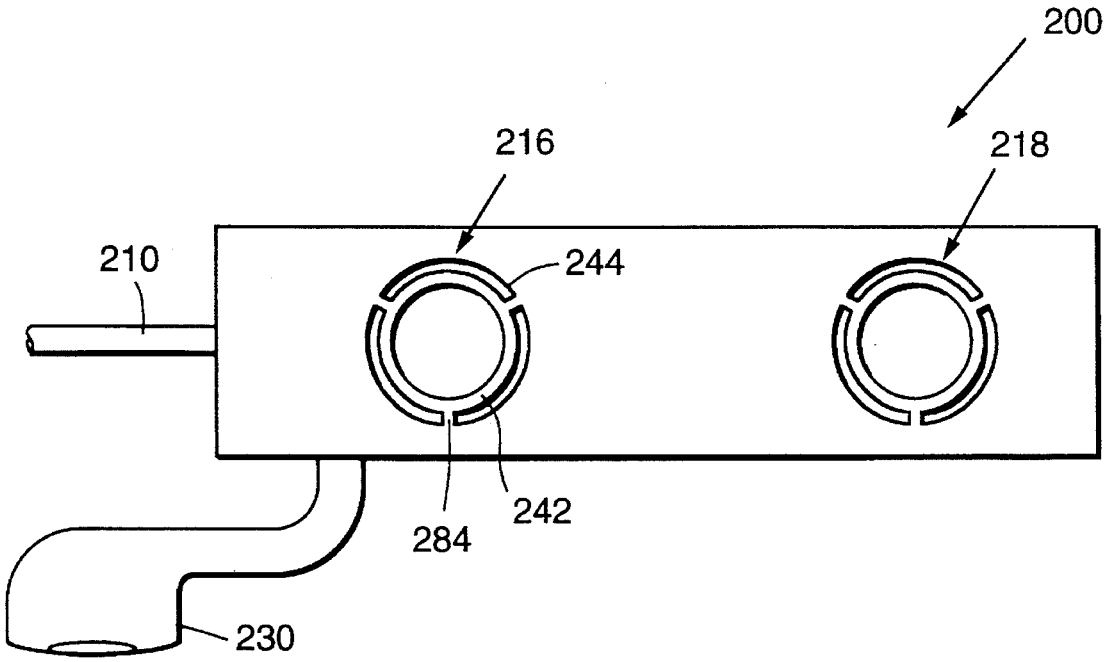

A side elevation and a plan view of a second embodiment of the burner according to the invention is shown in FIGS. 7A and 7B respectively. In FIGS. 7A and 7B, components corresponding to those in FIG. 3 are indicated with the same reference numeral with 100 added. In the burner 200 shown in FIGS. 7A and 7B, the plenum 212 is formed of a metal stamping or casting. Formed integrally with the plenum 212 are the nozzles 216 and 218, the flame stabilizers, such as the flame stabilizer 242, and the flame stabilizer supports, such as the flame stabilizer support 284. The second embodiment may be made with fewer or more nozzles than the two nozzles shown.

The flame stabilizer 242 is formed together with the nozzle 216 preferably in a single stamping operation, such that the width W of the flame stabilizer, and the spacing of the flame stabilizer from the bore 244 of the nozzle conform to the requirements set forth above.

Figure 8:
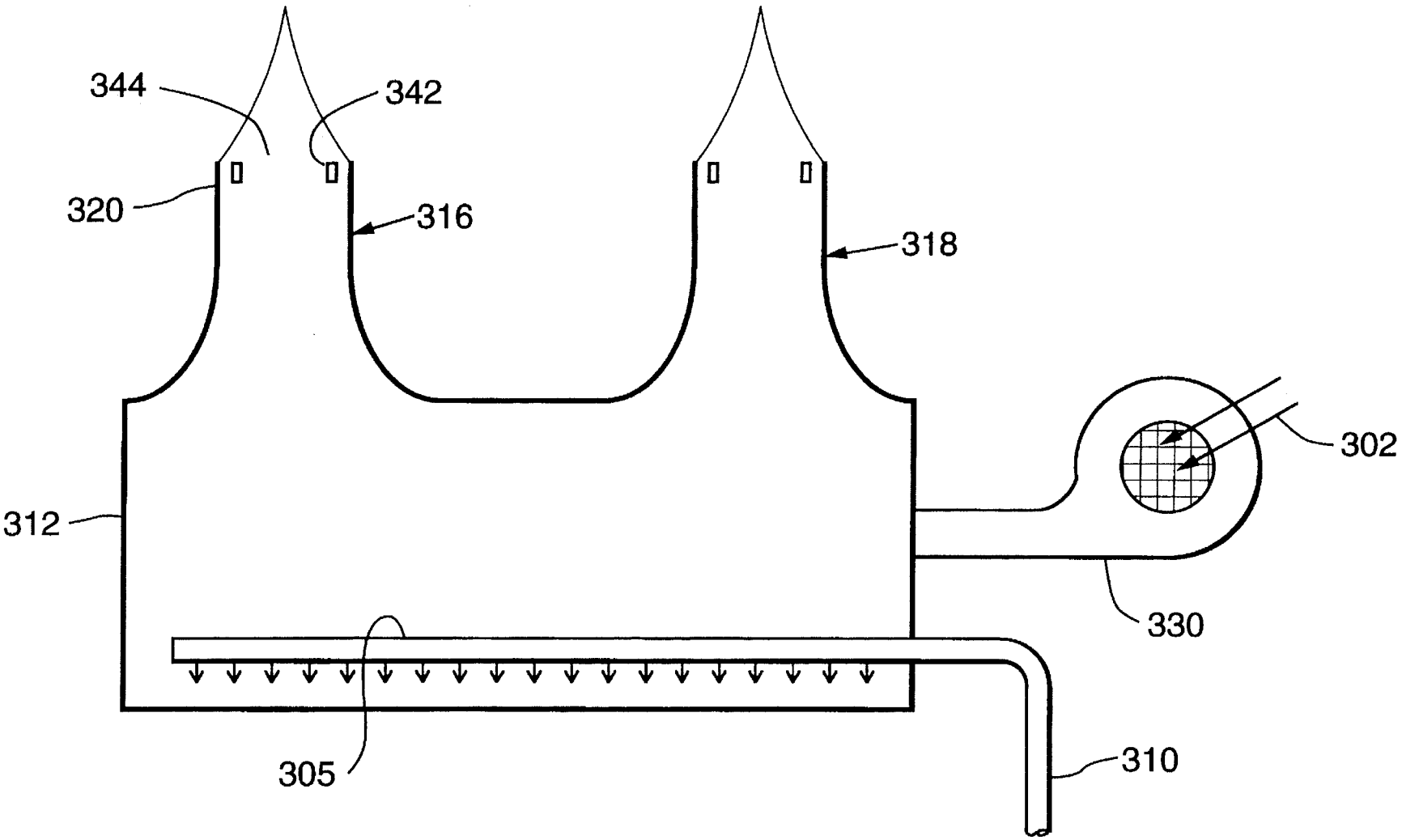
FIG. 8 is a cross sectional view of a third embodiment of a burner according to the invention.

A third embodiment of the burner according to the invention is shown in FIG. 8. In FIG. 8, components corresponding to those in FIG. 3 are indicated with the same reference numeral with 200 added. In the burner 300 shown in FIG. 8, the plenum 312 is formed of a metal stamping or casting. Formed integrally with the plenum 312 are the body portions 320 of nozzle 316, and the body portion of the nozzle 318. The nozzle 316 has the flame stabilizer 342 mounted in the bore 344 of its body portion 320. The width W of the flame stabilizer 342, and the spacing of the flame stabilizer from the bore 344 of the nozzle preferably conform to the requirements set forth above.

The third embodiment may be made with fewer or more nozzles than the two nozzles shown. The first and second embodiments shown in FIGS. 3, 7A and 7B may have the internal gas diffuser structure 305 shown in FIG. 8 for premixing the gas from the gas pipe 310 and the air from the blower 330.

Although the above description relates to burners for natural gas, it is predicted that the burner and flame stabilizer according to the invention will produce similar improvements in NOx levels while maintaining high efficiency when other gaseous fuel/air mixtures (or vaporized liquid fuel/air mixtures) are burned.

Although illustrative embodiments of the invention have been described herein in detail, it is to be understood that the invention is not limited to the precise embodiments described, and that various modifications may be practiced within the scope of the invention defined by the appended claims.

We claim:

1. Apparatus for enabling a burner operating in flee air to stably burn a premixed lean fuel/air mixture having a fuel/air equivalency ratio of less than unity to generate hot combustion products, the burner including a nozzle having an internal bore having an exit, means supplying a lean fuel/air mixture to said bore, the internal bore directing the lean fuel/air mixture in a stream towards the exit whereat the mixture is burned, the stream having a direction of flow, the internal bore having a bore width in a plane perpendicular to the direction of flow, the apparatus comprising:

a blunt annular flame stabilizer having a height in the direction of flow of between about 0.3 mm and about 10 mm, being spaced from the internal bore by between about 0.5 mm and about 15% of the bore width in the plane such that, when the annular flame stabilizer is mounted in the stream of the fuel/air mixture, the annular flame stabilizer divides the fuel/air mixture into an outer portion and an inner portion having substantially similar flow velocities, the annular flame stabilizer having a blunt cross section and having a width in the plane sufficient for the blunt annular flame stabilizer to create, when the blunt annular flame stabilizer is mounted in the stream of the fuel/air mixture, downstream eddies in both the outer portion and the inner portion of the fuel/air mixture, the eddies causing a portion of the hot combustion products to recirculate into the stream of the fuel/air mixture to continuously re-ignite the fuel/air mixture; and means for mounting the blunt annular flame stabilizer in the bore of the nozzle adjacent the exit.

2. The apparatus of claim 1, wherein the internal bore has a cross-sectional shape in the plane, and wherein the blunt annular flame stabilizer is shaped to conform to the cross-sectional shape of the internal bore.

3. The apparatus of claim 2, wherein the blunt annular flame stabilizer has a blunt cross section in a direction substantially perpendicular to the stream.

4. The apparatus of claim 3, wherein the internal bore has a circular cross section, and the blunt annular flame stabilizer is circular in the plane perpendicular to the direction of flow.

5. The apparatus of claim 2, wherein:

the cross-sectional shape of the internal bore is circular, and the internal bore has a bore diameter; and the blunt annular flame stabilizer is spaced from the internal bore by a distance greater than about 0.5 mm and less than about 15 percent of the bore diameter.

6. Apparatus for burning a gaseous fuel with low NOx and low HC emission in free air at substantially atmospheric pressure to generate hot combustion products, the apparatus comprising:

premixing means for premixing air with the fuel to provide a lean fuel/air mixture having a fuel/air equivalency ratio of less than unity;

a nozzle including an internal bore having an exit, the lean fuel/air mixture passing in a stream through the internal bore towards the exit and burning adjacent thereto, the stream having a direction of flow, the internal bore having a bore width in a plane perpendicular to the direction of flow; and a blunt annular flame stabilizer means, mounted in the stream of the lean fuel/air mixture spaced from the internal bore by between about 0.5 mm and about 15% of the bore width in the plane, and having a height in the direction of flow of between about 0.3 mm and 10 mm, for dividing the stream of the fuel/air mixture into an outer portion and an inner portion having substantially similar flow velocities, the blunt annular flame stabilizer means having sufficient width in the plane for the annular flame stabilizer means to create downstream eddies in both the inner portion and the outer portion of the fuel/air mixture, the eddies recirculating a portion of the hot combustion products into the stream of the fuel/air mixture to continuously re-ignite the fuel/air mixture.

7. The apparatus of claim 6, wherein the blunt annular flame stabilizer means is mounted in the internal bore.

8. The apparatus of claim 7, wherein:

the internal bore has a cross sectional shape in the plane; and the blunt annular flame stabilizer means is shaped to conform to the cross sectional shape of the internal bore.

9. The apparatus of claim 8, wherein the blunt annular flame stabilizer means has a downstream face and is mounted in the internal bore with the downstream face substantially flush with the exist.

10. The apparatus of claim 8, wherein:

the cross-sectional shape of the internal bore is circular, and the internal bore has a bore diameter; and the blunt annular flame stabilizer means is spaced from the internal bore by a distance greater than about 0.5 mm and less than about 15% of the bore diameter.

11. The apparatus of claim 7, wherein the blunt annular flame stabilizer means has a downstream face, and is mounted in the bore with the downstream face substantially flush with the exit.

12. The apparatus of claim 7, wherein the blunt annular flame stabilizer means has a width in the plane of about 1 mm.

13. The apparatus of claim 6, wherein the premixing means and the nozzle are formed as an integral unit.

14. The apparatus of claim 6, wherein the premixing means, the nozzle, and the blunt annular flame stabilizer means are formed as an integral unit.

15. A method of burning a lean fuel/air mixture with low NOx and low HC emission in free air at substantially atmospheric pressure to generate hot combustion products, the method comprising steps of:

providing a lean fuel/air mixture having a fuel/air equivalency ratio of less than unity;

directing the lean fuel/air mixture in a stream, the stream having a direction of flow, and an extent in a plane perpendicular to the direction of flow;

providing a blunt, substantially annular flame stabilizer having a length in the direction of flow of between about 0.3 mm and about 10 mm;

mounting the annular flame stabilizer in the stream of the fuel/air mixture to divide the stream into an outer portion and an inner portion having substantially similar flow velocities, the annular flame stabilizer dividing the fuel/air mixture at a point inset from the extent of the stream by between about 0.5 mm and about 15% of the extent of the stream in the plane, and dividing the stream over a width sufficient to create recirculating eddies in both the outer portion and the inner portion of the stream of the fuel/air mixture; and igniting the stream of the lean fuel/air mixture at the eddies, whereafter the eddies recirculate a portion of the hot combustion products into the stream to continuously re-ignite the fuel/air mixture.

16. The method of claim 15, wherein the step of mounting the annular flame stabilizer in the stream creates the eddies at a point in the stream of the lean fuel/air mixture not exposed to the ambient air.

17. The method of claim 15, wherein:

in the step of directing the lean fuel/air mixture in a stream, the stream is confined to a cross-sectional shape; and the annular flame stabilizer is shaped to conform to the cross-sectional shape.

18. Apparatus for burning a gaseous fuel with low NOx and low HC emission to generate hot combustion products, the apparatus comprising:

premixing means for premixing air with the fuel to provide a lean fuel/air mixture having a fuel/air equivalency ratio of less than unity;

a nozzle having an internal bore wherethrough the lean fuel/air mixture passes in a stream, the stream having a direction of flow, the internal bore including an exit, and having a bore width in a plane perpendicular to the direction of flow; and a blunt annular flame stabilizer means, mounted in the stream of the lean fuel/air mixture in the internal bore spaced from the internal bore by between about 0.5 mm and about 15% of the bore width in the plane, having a height in the direction of flow of between about 0.3 mm and 10 mm, and including a downstream face substantially flush with the exit, for dividing the stream of the fuel/air mixture into an outer portion and an inner portion having substantially similar flow velocities, the annular flame stabilizer means having a width in the plane sufficient to create downstream eddies in both the outer portion and the inner portion of the fuel/air mixture, the eddies recirculating a portion of the hot combustion products into the stream to continuously re-ignite the fuel/air mixture.

19. The apparatus of claim 18, wherein:

the internal bore has a cross sectional shape; and the blunt annular flame stabilizer means is shaped to conform to the cross sectional shape of the internal bore.

20. The apparatus of claim 18, wherein:

the cross-sectional shape of the internal bore is circular, and the internal bore has a bore diameter; and the blunt annular flame stabilizer means is spaced from the internal bore by a distance greater than about 0.5 mm and less than about 15% of the bore diameter.

21. The apparatus of claim 18, wherein the blunt annular flame stabilizer means has a width in the plane of about 1 mm.

22. The apparatus of claim 18, wherein the premixing means and the nozzle are formed as an integral unit.

23. The apparatus of claim 18, wherein the premixing means, the nozzle, and the blunt annular flame stabilizer means are formed as an integral unit.

* * * * *